US008276595B2

(12) United States Patent
Maor et al.

(10) Patent No.: US 8,276,595 B2
(45) Date of Patent: Oct. 2, 2012

(54) LICE COMB

(75) Inventors: Moshe Maor, Perth (AU); Edward J. Khoury, Perth (AU); Robert C. A. Culley, Perth (AU)

(73) Assignees: David J. Schwartz, Perth (AU); Moshe Maor, Perth (AU)

( * ) Notice: Subject to any disclaimer, the term of this patent is extended or adjusted under 35 U.S.C. 154(b) by 731 days.

(21) Appl. No.: 12/377,672

(22) PCT Filed: Aug. 23, 2007

(86) PCT No.: PCT/AU2007/001201

§ 371 (c)(1),
(2), (4) Date: Feb. 17, 2009

(87) PCT Pub. No.: WO2008/022386

PCT Pub. Date: Feb. 28, 2008

(65) Prior Publication Data

US 2011/0005540 A1 Jan. 13, 2011

(30) Foreign Application Priority Data

Aug. 24, 2006 (AU) ..... 2006904605

(51) Int. Cl.
*A45D 24/00* (2006.01)
*A01K 13/00* (2006.01)

(52) U.S. Cl. ..... 132/147; 132/148; 119/609

(58) Field of Classification Search ..... 132/147, 132/219, 162, 163; 43/133–136; 119/609
See application file for complete search history.

(56) References Cited

U.S. PATENT DOCUMENTS

| | | | | |
|---|---|---|---|---|
| 4,599,823 | A * | 7/1986 | Lee | 43/134 |
| 4,815,232 | A * | 3/1989 | Rawski | 43/136 |
| 5,207,183 | A * | 5/1993 | Praschnik et al. | 119/609 |
| 5,271,179 | A * | 12/1993 | Cohen | 43/131 |
| 5,634,293 | A | 6/1997 | Mike et al. | |
| 5,870,851 | A * | 2/1999 | Shoemaker | 43/114 |
| 6,098,633 | A | 8/2000 | Pabari | |
| 6,115,958 | A | 9/2000 | Enderle | |
| 2001/0037772 | A1 | 11/2001 | Huddleston | |
| 2002/0078972 | A1 | 6/2002 | Levandovsky | |
| 2005/0051190 | A1 | 3/2005 | Bachrach et al. | |
| 2006/0177473 | A1 | 8/2006 | Safai | |

FOREIGN PATENT DOCUMENTS

GB 2342291 A 4/2000

OTHER PUBLICATIONS

International Search Report dated Sep. 12, 2007 for PCT/AU2007/001201.

Supplementary European Search Report for EP07784838, dated Aug. 19, 2010.

* cited by examiner

*Primary Examiner* — Robyn Doan
(74) *Attorney, Agent, or Firm* — Bachman & LaPointe, P.C.

(57) ABSTRACT

A lice comb (10) including a plurality of teeth (14) for capturing lice when the teeth (14) are passed through hair. The lice comb (10) is provided with a receptacle (22) including an adhesive inner surface and a means for moving lice captured by the teeth (14) into the receptacle (22) such that the lice come into contact with the adhesive surface, preventing escape of the lice.

18 Claims, 13 Drawing Sheets

SECTION A-A

LICE COMB

FIELD OF THE INVENTION

The present invention relates to a comb for removing lice from hair.

BACKGROUND OF THE INVENTION

Many devices have been devised to remove lice from hair. Lice combs are available that attempt to trap the lice between the teeth of the comb and thereby remove the lice. However in such devices, even if the lice are removed from the hair, if they are not killed they can potentially remain in the nearby environment where they can potentially re-infest the same or other persons.

Some lice combs have attempted to overcome this problem by means devised to kill the lice. One example is the use of electric current provided to the teeth of the comb such that the current can pass through the lice across the teeth, thereby electrocuting the lice. Such devices however have only limited effectiveness.

The present invention attempts to provide an improved lice comb to both remove lice from hair and prevent the removed lice re-infesting.

SUMMARY OF THE INVENTION

In accordance with one aspect of the present invention there is provided a lice comb comprising:

a plurality of teeth for capturing lice when the teeth are passed through hair;

a receptacle including an adhesive inner surface; and a means for moving lice captured by the teeth into the receptacle such that the lice come into contact with the adhesive surface, preventing escape of the lice.

Preferably, passing the teeth through the hair captures lice on an upper surface of the teeth and the means for moving lice comprises a wiper element moved in reciprocal manner across the upper surface such that the wiper element moves the captured lice from the upper surface into the receptacle.

In a preferred embodiment, the wiper element includes a blade moveable between a first position as the wiper element moves in one direction across the upper surface of the teeth in which the blade contacts the upper surface of the teeth and a second position as the wiper element moves in the opposite direction across the upper surface of the teeth in which the blade does not contact the upper surface of the teeth. Preferably, the teeth include a longitudinal aperture along the width of the teeth, the aperture being located above, in use, the receptacle such that lice captured on the upper surface of the teeth are moved by the blade of the wiper element to fall through the aperture and into the receptacle.

In one embodiment, the wiper element comprises a cylindrical member rotatably mounted in a wiper support member, the blade extending from the cylindrical member along the width thereof and the wiper support member being moved in a sliding reciprocal manner within a support frame. The support frame may comprise a U-shaped member having inwardly facing slots and the wiper support member is received within the slots.

The cylindrical member preferably includes lugs on opposite ends thereof, the lugs engaging with a lower surface of the slots as the wiper element moves through its range of travel and wherein the lugs fall off the lower surface at each end of the lower surface such that when the wiper element changes direction, the lugs engage with the ends of the lower surface thereby rotating the cylindrical member and the blade between the first and second positions. The cylindrical member may be provided with biasing means connected to the wiper support member to bias the lugs to move to a position in which the lugs extend generally downwardly relative to the lower surface when the lugs pass the ends of the lower surface. The biasing means may comprise flexible tabs that are secured to the lower portion of the wiper support member.

In a preferred embodiment, the lugs include two perpendicular surfaces extending from the radial outer end of the lug such that one of said surfaces engages with the lower surface when the wiper element is travelling in one direction and the other of said surfaces engages with the lower surface when the wiper element is travelling in the other direction, the blade therefore being rotated 90 degrees between the first and second positions thereof. In the first position, the blade may be perpendicular to the upper surface of the teeth and in the second position, the blade parallel to the upper surface of the teeth.

A drive wheel may be provided having a cam member mounted thereon, the cam member engaging with a slot on the wiper support member such that rotation of the drive wheel causes reciprocating movement of the wiper support member. The drive wheel may be rotated by a worm gear engaging with cogs around the outer surface of the drive wheel, the worm gear being driven by an electric motor.

Preferably, the teeth and the means for moving captured lice are mounted within a housing and the receptacle is secured to the housing. The receptacle may be detachably connected to the housing.

In one embodiment, the receptacle is arranged such that when the receptacle and the ends of the teeth engage with surface of the head of a user, the teeth are approximately tangential to the surface of the head.

Preferably, the adhesive inner surface comprises a gel substance provided in the receptacle.

BRIEF DESCRIPTION OF THE DRAWINGS

The present invention will now be described, by way of example, with reference to the accompanying drawings, in which.

DESCRIPTION OF THE PREFERRED EMBODIMENTS

Referring to the Figures, there is shown a lice comb 10 in accordance with the present invention. The lice comb 10 includes a housing 12 having a set of teeth 14 extending from an end thereof. The teeth 14 are provided in a generally known configuration, being a plane of parallel teeth, spaced sufficiently closely such that hair will pass between the teeth and lice within the hair will be captured on the upper surface 16 of the teeth 14.

Figure 1:
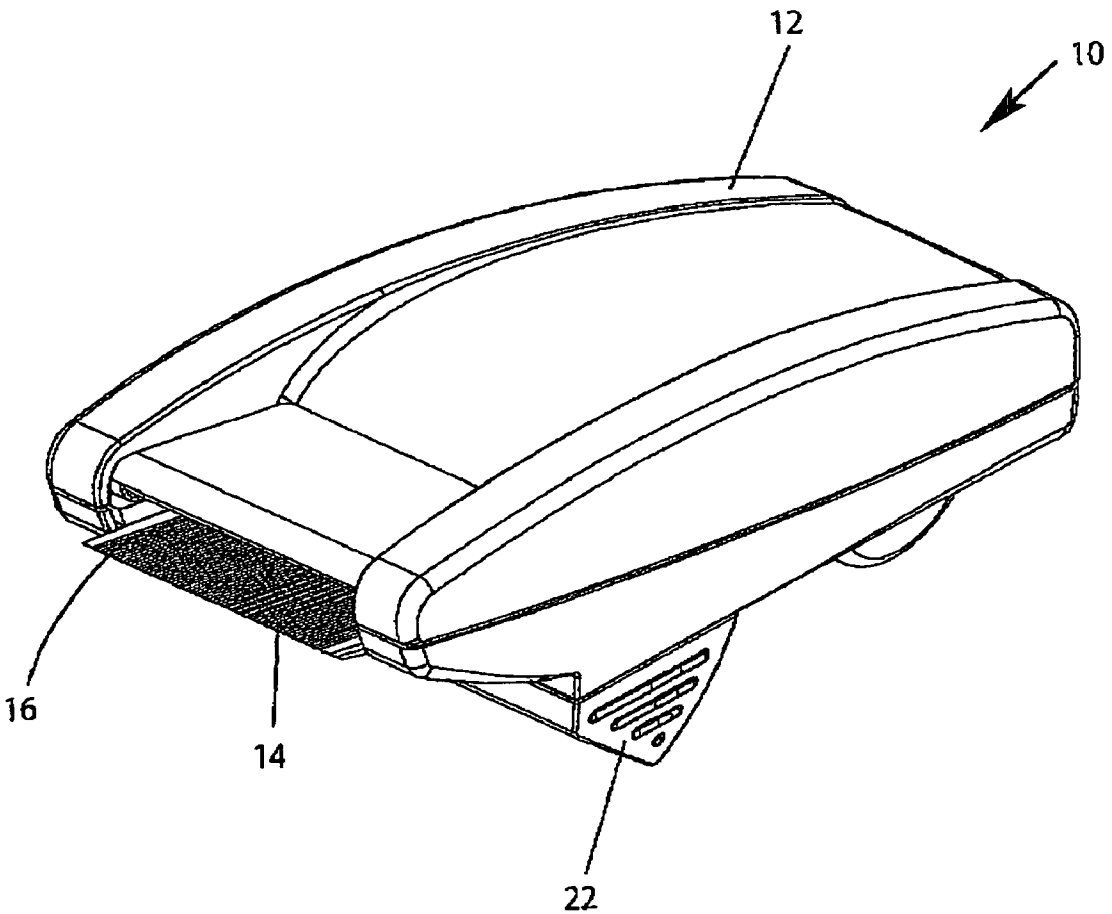
FIG. 1 is an upper perspective view of a lice comb in accordance with the present invention.
Figure 2:
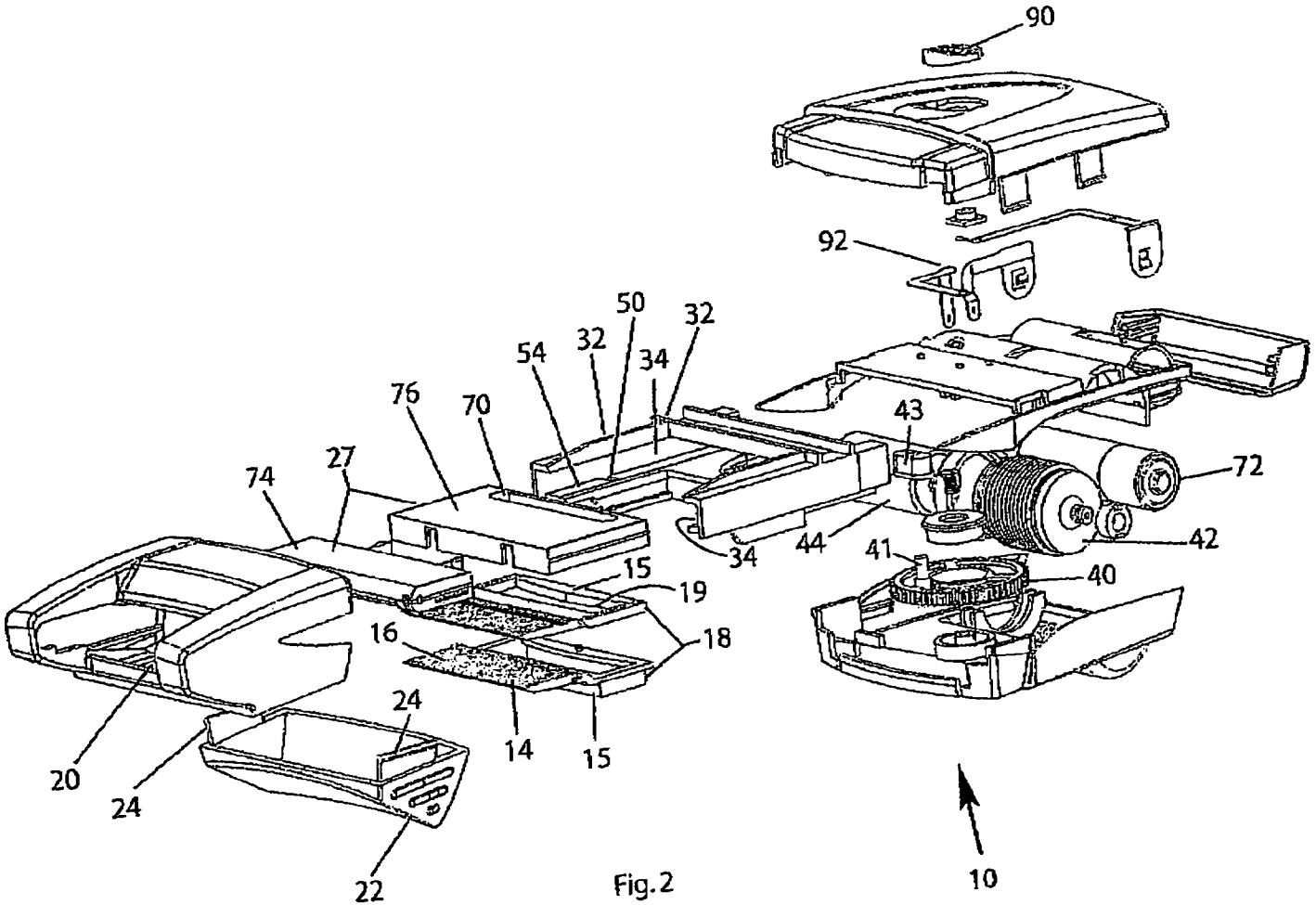
FIG. 2 is an exploded view of the lice comb of FIG. 1.
Figure 3A:
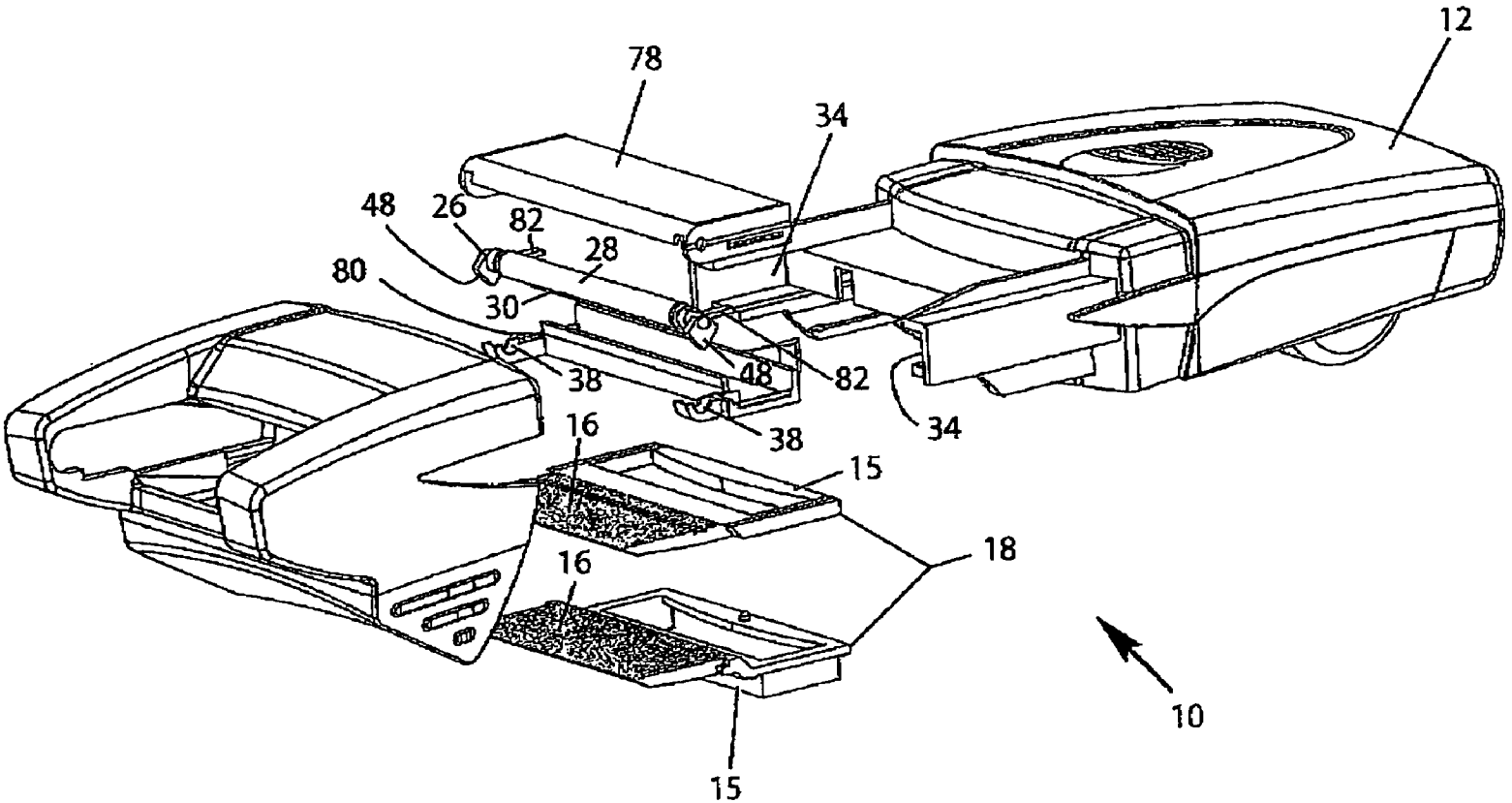
FIG. 3*a* is a partially assembled view of the lice comb of FIG. 1.
Figure 3B:
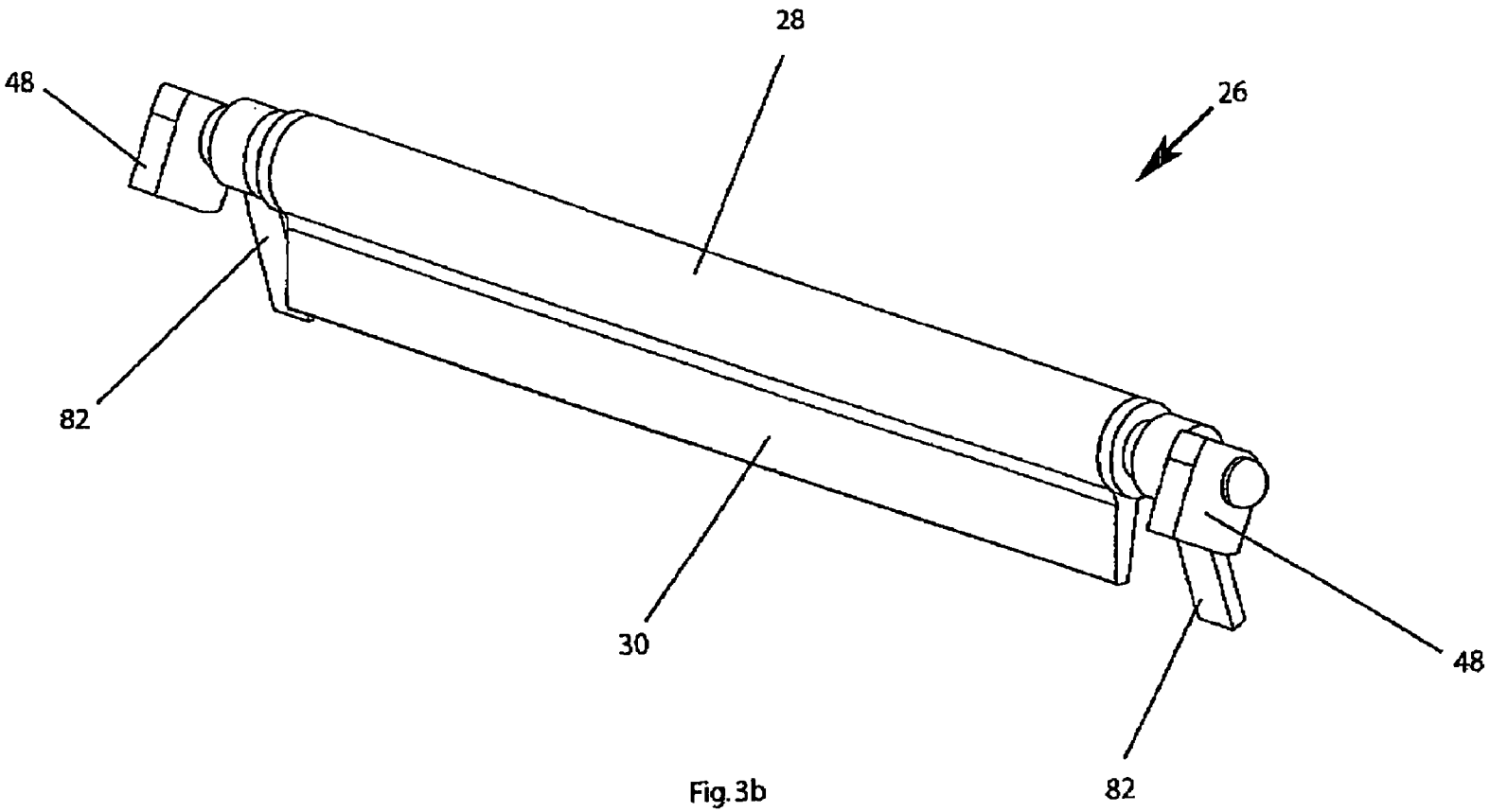
FIG. 3*b* is a close up view of the wiper element of FIG. 3*a;*

The teeth 14 extend from along the length of a front side of a base member 18 held within the housing 12. The teeth 14 may be provided as a pair of comb units 15 as shown in FIG. 3, wherein the pair of comb units 15 are placed one on top of the other with the teeth 14 of the first of the two combs being interspersed between the teeth 14 of the second of the pair of comb units 15. The base member 18 comprises a first base portion connected to the first of the comb units 15 and a second base portion connected to the second of the comb units 15. The first and second base portions connect together to form the base member 18. The base member 18 also includes a longitudinal aperture 19 extending along the width of the teeth 14.

The housing 12 includes a longitudinal opening 20 along the length of and below, in use, the aperture 19 of the base member 18. That is, when the lice comb 10 is in use, any matter falling through the aperture 19 of the base member 18 will fall out of the housing 12 through the opening 20.

The lice comb 10 includes a receptacle 22 removably securable to the housing 12 below the opening 20. In the embodiment shown, the receptacle 22 is secured by flexible connectors 24 located at opposed ends of the receptacle 22 that are received in opposed ends of the opening 20. The receptacle 22 includes an adhesive interior surface such that any lice falling into the receptacle 22 through the opening 20 contact the adhesive surface and become stuck to the adhesive surface. The adhesive surface may be provided in any suitable form such that lice coming into contact with the adhesive surface cannot escape. For example, the receptacle 22 may be filled or lined with a gel substance such that the exposed upper surface of the gel forms the adhesive surface.

Figure 7:
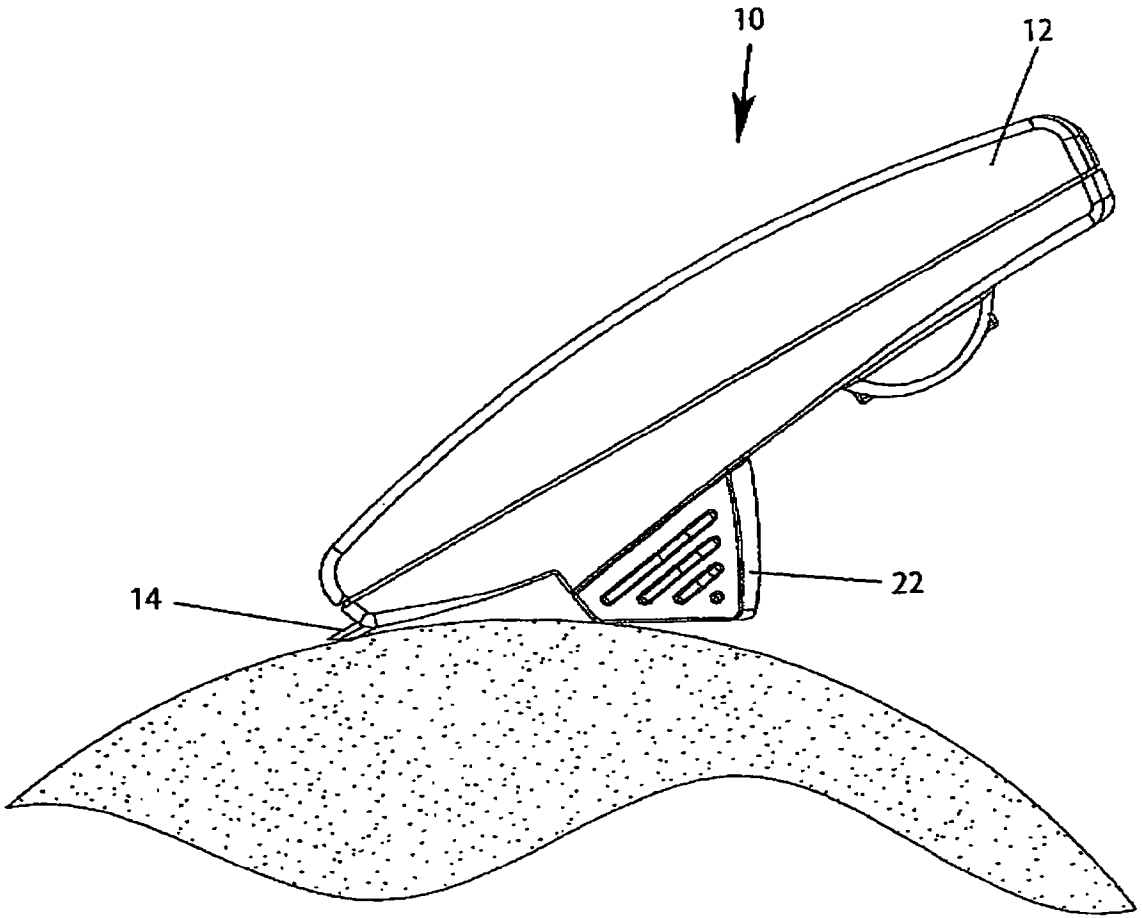
FIG. 7 is a side view of the lice comb of FIG. 1 in operation on a human head.

The lice comb 10 also includes a means for moving lice captured by the teeth 14 into the receptacle 22. In use, the teeth 14 are passed through the hair with the teeth 14 generally parallel to the surface from which the hair extends. FIG. 7 shows an example of the lice comb 10 in use on a human head (with the hair omitted from the drawing). On a curved surface such as the head, the teeth 14 remain approximately tangential to the head. Preferably, the housing 12 and receptacle 22 are arranged such that when the teeth 14 and receptacle 22 are rested against the head, the teeth 14 are approximately tangential to the head as shown. By moving the lice comb 10 in the direction of the teeth 14, the hair strands pass downwardly through the teeth 14.

Lice in the hair do not pass through the teeth 14 and remain on the upper surface 16 of the teeth 14. The means for moving lice therefore moves lice from the upper surface 16 of the teeth 14 towards the aperture 19 of the base member 18 where they can fall through the opening 20 into the receptacle 22.

The means for moving the lice includes a wiper element 26 comprising a cylindrical member 28 approximately equal in length to the width of the teeth 14 having a longitudinal blade 30 thereon. The lice comb 10 is provided with a mechanism to move the wiper element 26 in reciprocating motion along the teeth 14 such that when moving in a direction toward the ends of the teeth 14, the blade 30 does not contact the upper surface 16 of the teeth 14. When the wiper element 26 is moving towards the base member 18, the blade 30 is in contact with the upper surface 16 of the teeth 14 such that the blade 30 pulls any lice on the teeth 14 to the rear surface of the base member 18 where they fall through the opening 20 into the receptacle 22.

The mechanism to move the wiper element 26 includes a wiper support member 27 slidably mounted within a support frame 32. The support frame 32 comprises a generally U-shaped member having a pair of inwardly facing slots 34. The wiper support member 27 is received between and slidable within the slots 34.

The wiper element 26 is moved through its path of travel by a cam member 41 on a drive wheel 40 to create reciprocal movement of the wiper support member 27. The wiper support member 27 includes a groove 70 perpendicular to the direction of the slots 34 into which is received the cam member 41. Rotational movement of the drive wheel 40 and cam member 41 thereby cause reciprocal movement in the slots 34 of the wiper support member 27. The cam 41 is also provided with a cap member 43 of generally obround cross sectional shape and of the same width as the groove. The cap member 43 is received in the groove 70.

The drive wheel 40 in the embodiment shown includes cogs around the outer surface thereof engaged by a worm gear 42 driven by an electric motor 44. The electric motor is driven by a battery 72. The housing 12 includes a button 90 that closes contacts 92 to power the electric motor 44.

The wiper support member 27 comprises a first portion 74 and a second portion 76. The first portion receives the wiper element 26 and is connectable to the second portion, which includes the groove 70. The first portion 74 comprises a lower portion 80 and an upper portion 78. The lower portion 80 includes a pair of arcuate recesses 38 into which are received ends of the cylindrical member 28 such that the cylindrical member is rotatable within the arcuate recesses 38. The upper portion 78 is secured to the lower portion 80 such that the cylindrical member 28 is secured within the arcuate recesses 38.

The movement of the blade 30 as the wiper element 26 travels is effected by lugs 48 extending radially from ends of the cylindrical member 28. The cylindrical member 28 also includes biasing means which bias the lugs to move to a position in which the lugs extend generally downwardly relative to the lower surface, when the lugs pass the ends of the lower surface. In the embodiment shown, the biasing means comprise flexible tabs 82 that extend generally horizontally in use and are secured to the lower portion 80 of the wiper support member 27. The biasing means however may be any other suitable means to perform the required function.

When the flexible tabs 82 are secured in this horizontal position, the lugs 48 extend generally downwardly and the blade 30 extends at an angle of approximately 45 degrees between the lugs 48 and the flexible tabs 82 as can be seen in FIG. 4.

Also provided are recesses 50 at the inner ends of the lower surfaces 54 of the slots 34. The lugs 48 are located such that when the wiper support member 27 is received in the slots 34, the lugs 48 engage with the lower surface 54, rotating the cylindrical member 28 and bending the flexible tabs 82. When the lugs 48 move above either the recesses 50 at the inner ends of the lower surface 54 or past the outer end of the lower surface 54, the lugs 48 move downwardly, as the flexible tabs 82 bend back.

The lugs 48 include two surfaces extending from the radial outer end thereof at 90 degrees to each other. The two perpendicular surfaces are arranged such that one of these surfaces engages the lower surface 54 when the wiper element 26 travels in one direction and the other surface engages the lower surface 54 when the wiper element 26 travels in the other direction, as will be described below.

Figure 4A:
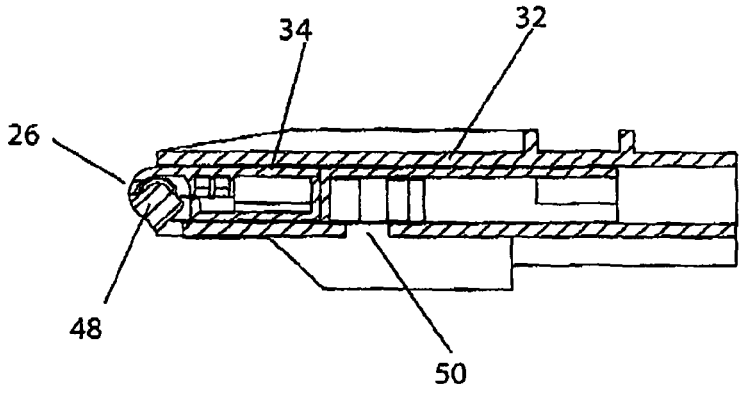
FIGS. 4*a* to 4*g* are side views of the means for moving lice captured by the teeth into the receptacle of the lice comb in various stages of operation.
Figure 5A:
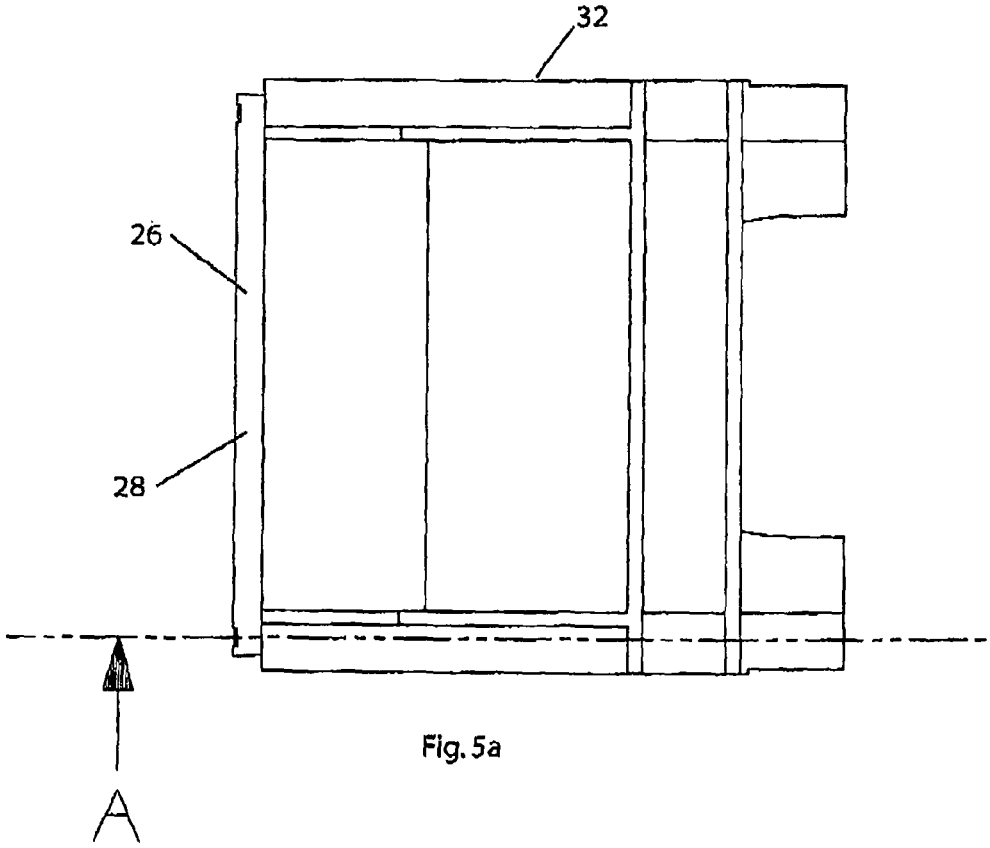
FIGS. 5*a* to 5*g* are top views corresponding to FIGS. 4*a* to 4*g;*
Figure 4B:
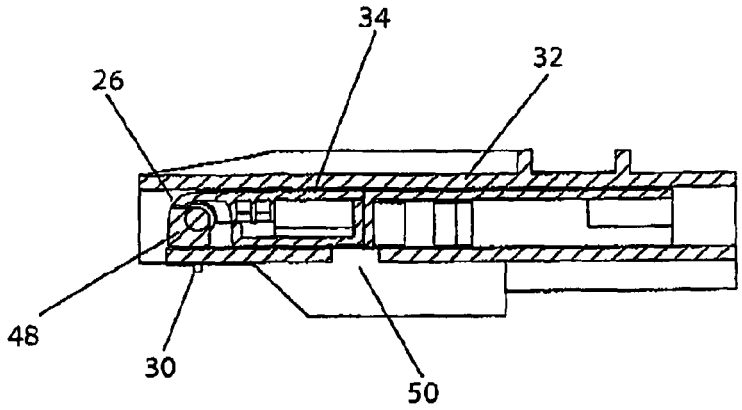
Figure 5B:
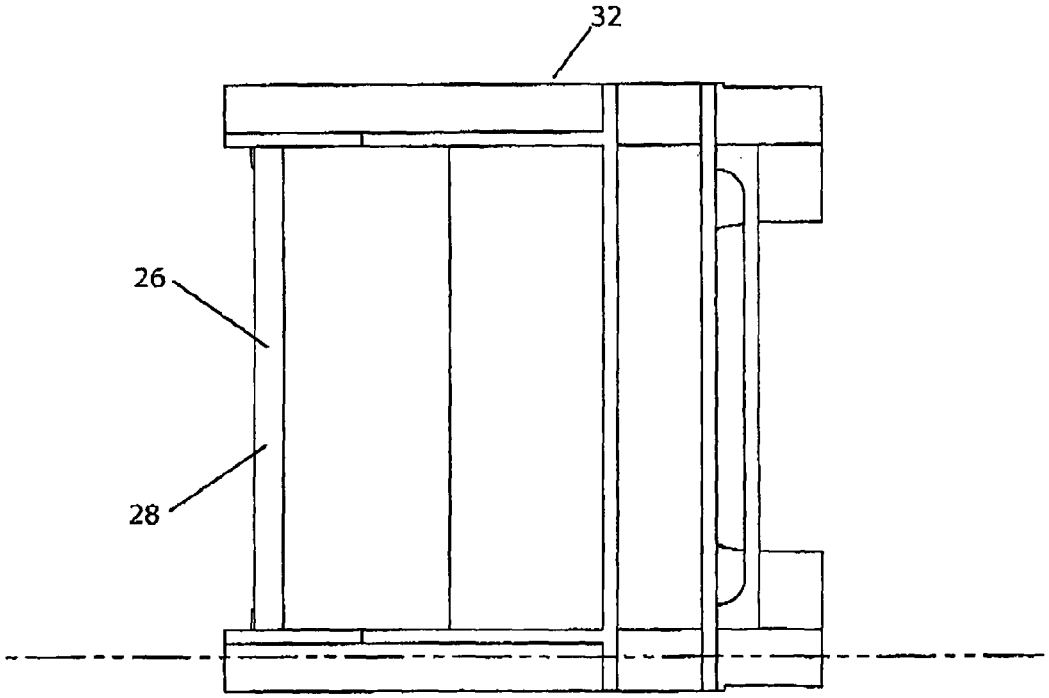
Figure 4C:
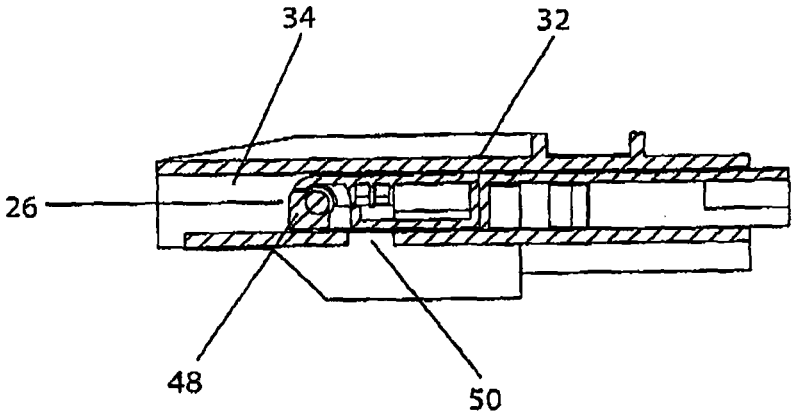
Figure 5C:
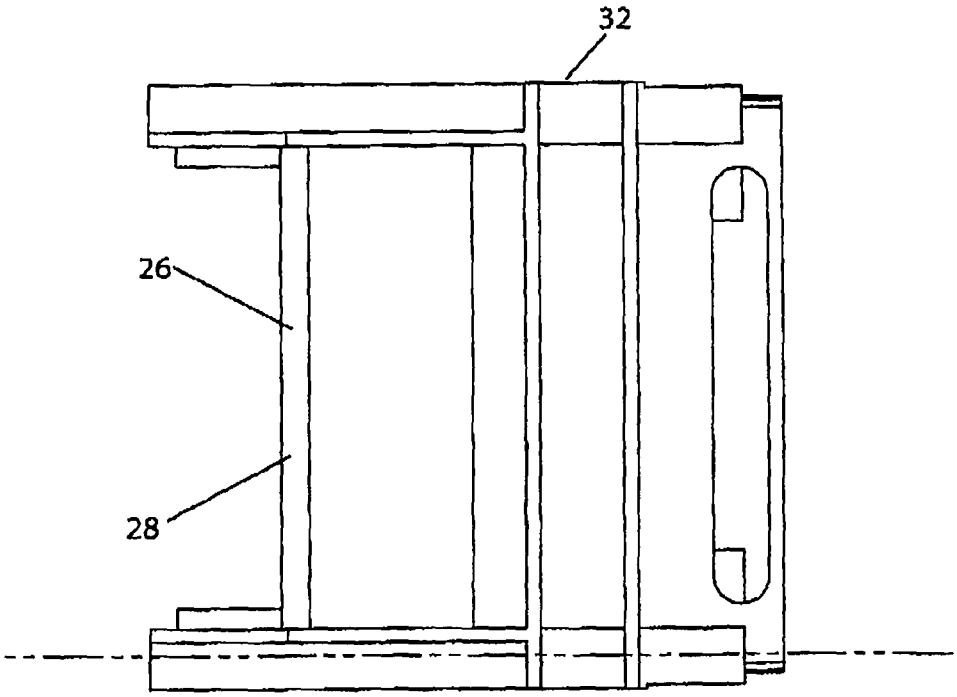
Figure 4D:
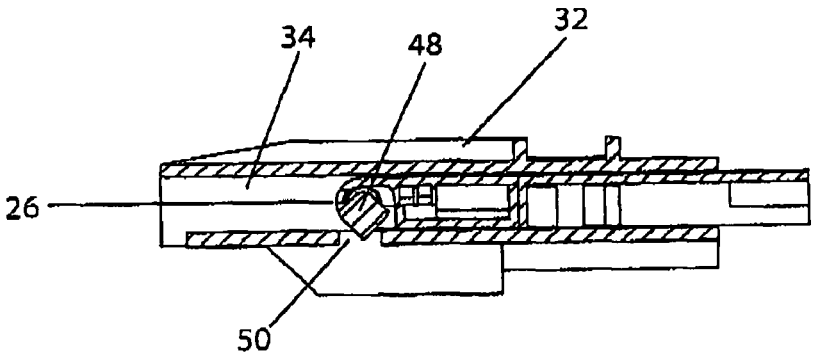
Figure 5D:
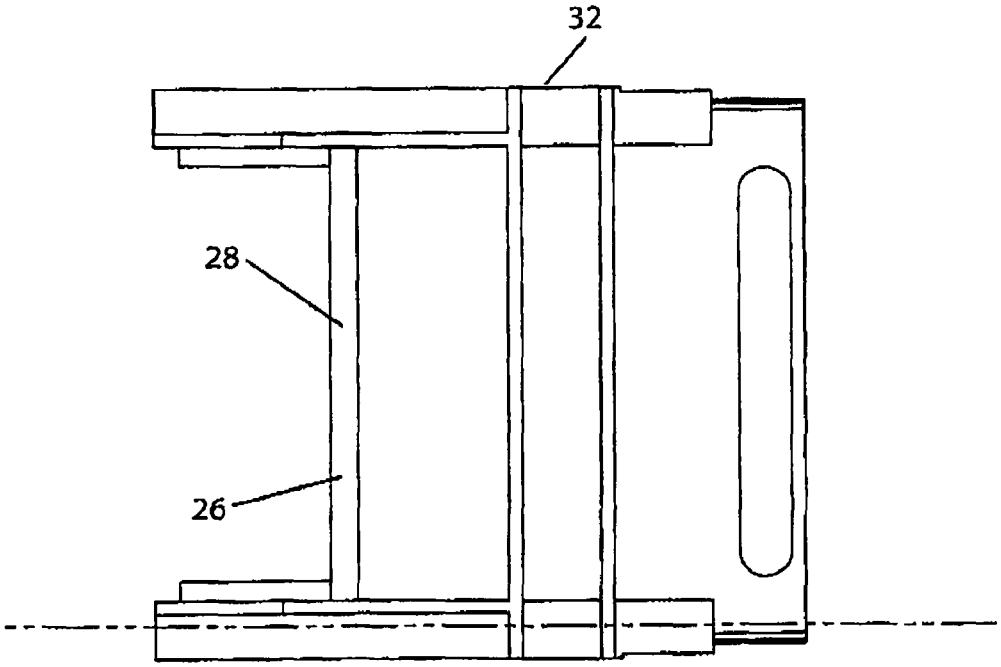

When the lugs 48 fall past the end of the lower surface 54 and point generally downwardly, the blade 30 is angled downwardly and back towards the base member 18 as shown in FIG. 4*a*. When the cylindrical member 28 moves back towards the base member 18, the lugs 48 engage with the end of the lower surface 54 rotating the blade 30 to be directed downwardly (as shown in FIG. 4*b*). In this position, the blade 30 contacts the upper surface 16 of the teeth 14 and moves lice on the upper surface towards the receptacle 22.

Figure 4E:
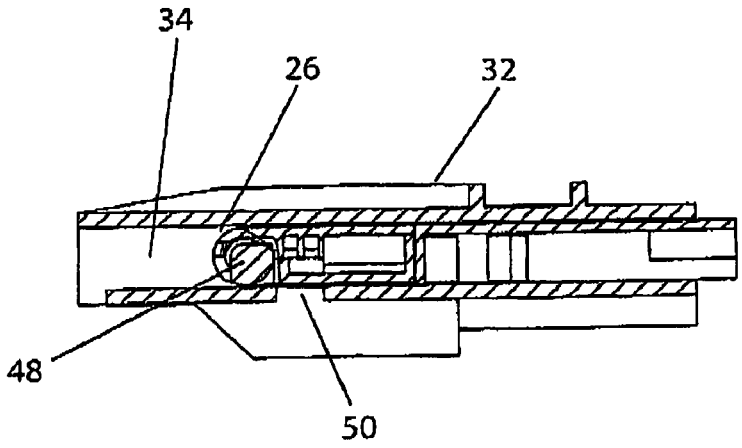
Figure 5E:
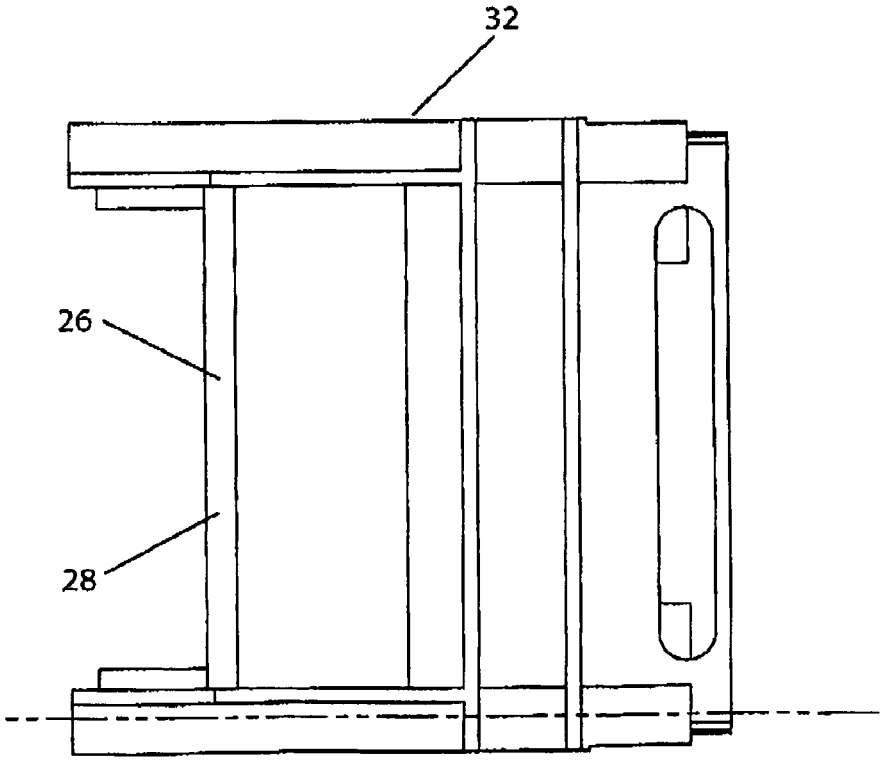
Figure 4F:
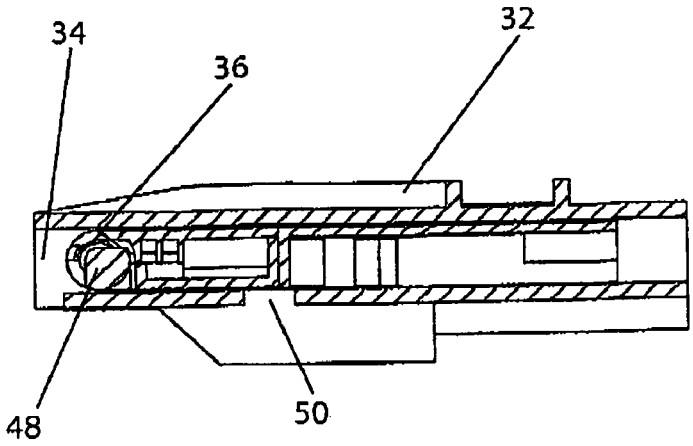
Figure 5F:
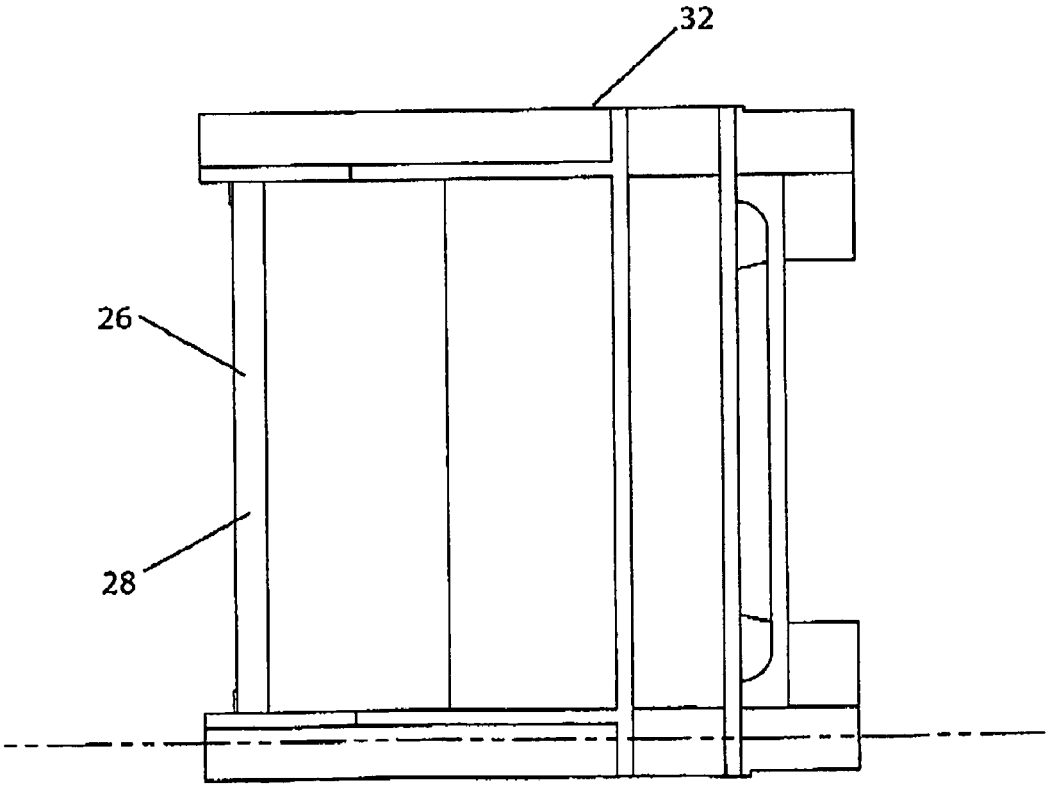
Figure 4G:
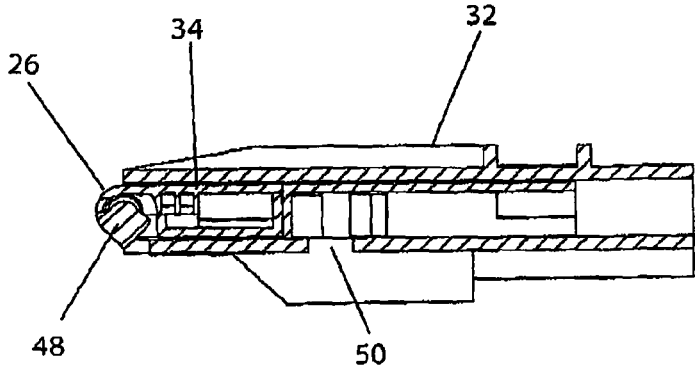
Figure 5G:
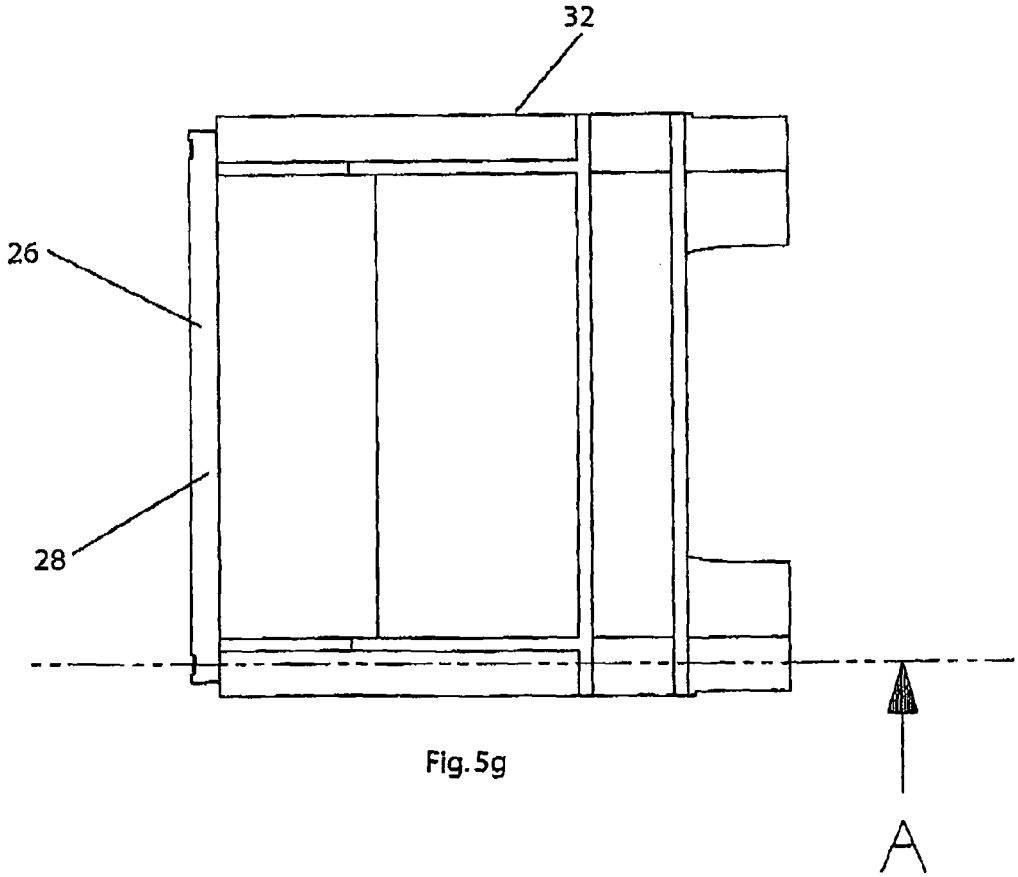

When the cylindrical member 28 reaches the inner end of its travel, the lugs 48 again fall into a downward position into the recesses 50. As the cylindrical member 28 moves back toward the outer end of the slots 34, the lugs 48 engage with edges of the recesses 50 which rotates the cylindrical member 28 until the blade 30 is oriented generally horizontally. Therefore as the cylindrical member 28 moves outwardly toward the end of the teeth 14, the blade 30 does not contact the upper surfaces 16 of the teeth 14 (as shown in FIG. 4*e*).

Therefore, in use, the reciprocating motion of the wiper element 26 draws lice along the upper surface 16 of the teeth 14 in one direction of movement but does not contact the upper surface 16 in the other direction. The lice are thereby drawn across the teeth 14 and the base member 18 where they fall into the receptacle 22.

As mentioned previously, the receptacle 22 is detachable in so that it can be properly cleaned and captured lice removed. The teeth 14 and the wiper element 26 are also removable from the housing 12 to allow effective cleaning.

Figure 6:
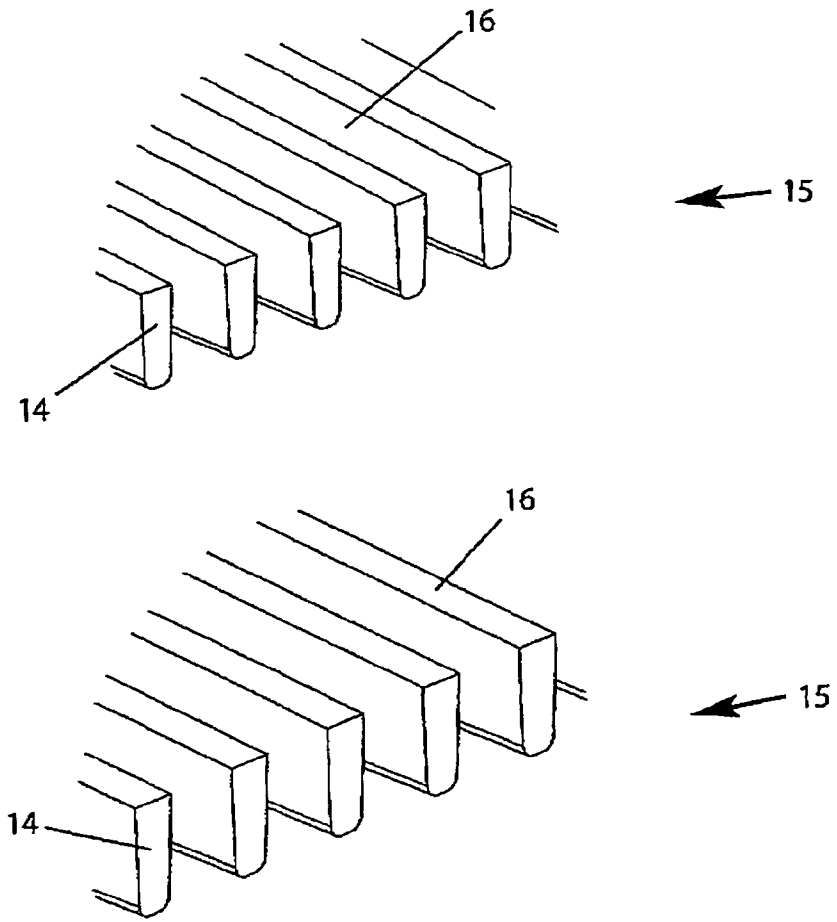
FIG. 6 is a side cross sectional view of teeth of the lice comb of the present invention.

As it is necessary in such an arrangement that the lice can be properly contacted by the blade 30, the cross sectional shape of the teeth 14 must be such that the lice sit on top of the teeth 14 and do not get caught between the teeth 14. The cross sectional shapes as shown in FIG. 6 is a preferred embodiment of such teeth 14.

These teeth 14 have generally trapezoidal cross sections with the base of the trapezoid forming the upper surface 16.

Modifications and variations as would be apparent to a skilled addressee are deemed to be within the scope of the present invention.

The invention claimed is:

1. A lice comb comprising:

a plurality of teeth such that passing the teeth through the hair captures lice on an upper surface of the teeth;

a receptacle including an adhesive inner surface; and a means for moving lice captured by the teeth into the receptacle such that the lice come into contact with the adhesive surface, preventing escape of the lice, the means comprising a wiper element moving in a reciprocating manner across the upper surface of the teeth to move the captured lice from the upper surface into the receptacle, the wiper element including a blade movable between:

a first position as the wiper element moves in one direction across the upper surface of the teeth in which the blade contacts the upper surface of the teeth; and a second position as the wiper element moves in the opposite direction across the upper surface of the teeth in which the blade does not contact the upper surface of the teeth.

2. A lice comb in accordance with claim 1, wherein the teeth include a longitudinal aperture along the width of the teeth, the aperture being located above, in use, the receptacle such that lice captured on the upper surface of the teeth are moved by the blade of the wiper element to fall through the aperture and into the receptacle.

3. A lice comb in accordance with claim 1, wherein the wiper element comprises a cylindrical member rotatably mounted in a wiper support member, the blade extending from the cylindrical member along the width thereof and the wiper support member being moved in a sliding reciprocal a support frame.

4. A lice comb in accordance with claim 3, wherein the support frame comprises a U-shaped member having inwardly facing slots and the wiper support member is received within the slots.

5. A lice comb in accordance with claim 4, wherein the cylindrical member includes lugs on opposite ends thereof, the lugs engaging with a lower surface of the slots as the wiper element moves through its range of travel and wherein the lugs fall off the lower surface at each end of the lower surface such that when the wiper element changes direction, the lugs engage with the ends of the lower surface thereby rotating the cylindrical member and the blade between the first and second positions.

6. A lice comb in accordance with claim 5, wherein the cylindrical member is provided with biasing means connected to the wiper support member to bias the lugs to move to a position in which the lugs extend generally downwardly relative to the lower surface when the lugs pass the ends of the lower surface.

7. A lice comb in accordance with claim 6, wherein the biasing means comprise flexible tabs that are secured to the lower portion of the wiper support member.

8. A lice comb in accordance with claim 7, wherein the lugs include two perpendicular surfaces extending from the radial outer end of the lug such that one of said surfaces engages with the lower surface when the wiper element is travelling in one direction and the other of said surfaces engages with the lower surface when the wiper element is travelling in the other direction, the blade therefore being rotated 90 degrees between the first and second positions thereof.

9. A lice comb in accordance with claim 7, wherein in the first position, the blade is perpendicular to the upper surface of the teeth and in the second position, the blade is parallel to the upper surface of the teeth.

10. A lice comb in accordance with claim 5, wherein a drive wheel is provided having a cam member mounted thereon, the cam member engaging with a slot on the wiper support member such that rotation of the drive wheel causes reciprocating movement of the wiper support member.

11. A lice comb in accordance with claim 10, wherein the drive wheel is rotated by a worm gear engaging with cogs around the outer surface of the drive wheel, the worm gear being driven by an electric motor.

12. A lice comb in accordance with claim 11, wherein the electric motor is powered by one or more batteries.

13. A lice comb in accordance with claim 1, wherein the teeth and the means for moving captured lice are mounted within a housing and the receptacle is secured to the housing.

14. A lice comb in accordance with claim 13, wherein the receptacle is detachably connected to the housing.

15. A lice comb in accordance with claim 13, wherein the receptacle is arranged such that when the receptacle and the ends of the teeth engaged with surface of the head of a user, the teeth are approximately tangential to the surface of the head.

16. A lice comb in accordance with claim 13, wherein the adhesive inner surface comprises a gel substance provided in the receptacle.

17. A lice comb in accordance with claim 13 wherein the teeth are removable from the housing to allow for cleaning.

18. A lice comb in accordance with claim 13 wherein the wiper element is removable from the housing to allow for cleaning.

* * * * *